US008172630B2

(12) United States Patent
Wright

(10) Patent No.: US 8,172,630 B2
(45) Date of Patent: May 8, 2012

(54) MAN-OVER-BOARD RESCUE DEVICE

(75) Inventor: Robert Charles Wright, Castlecrag (AU)

(73) Assignee: Jomune Pty Limited, Castlecrag NSW (AU)

( * ) Notice: Subject to any disclaimer, the term of this patent is extended or adjusted under 35 U.S.C. 154(b) by 125 days.

(21) Appl. No.: 12/733,721

(22) PCT Filed: Sep. 17, 2008

(86) PCT No.: PCT/AU2008/001370

§ 371 (c)(1),
(2), (4) Date: Mar. 17, 2010

(87) PCT Pub. No.: WO2009/036494

PCT Pub. Date: Mar. 26, 2009

(65) Prior Publication Data

US 2010/0233923 A1 Sep. 16, 2010

(30) Foreign Application Priority Data

Sep. 18, 2007 (AU) ..... 2007905080
Dec. 17, 2007 (AU) ..... 2007906905
Jun. 3, 2008 (AU) ..... 2008902785

(51) Int. Cl.
*B63C 9/26* (2006.01)

(52) U.S. Cl. ..... 441/84; 441/80

(58) Field of Classification Search ..... 441/80, 441/83, 84

See application file for complete search history.

(56) References Cited

U.S. PATENT DOCUMENTS

| | | | | |
|---|---|---|---|---|
| 600,355 | A | 3/1898 | Burton | |
| 4,596,530 | A | 6/1986 | McGlinn | |
| 5,320,566 | A | 6/1994 | Low, Jr. | |
| 5,370,565 | A | 12/1994 | Yanez | |
| 5,598,592 | A | 2/1997 | Castellani | |
| 5,779,511 | A | 7/1998 | Davidson, Jr. | |
| 7,223,142 | B1 * | 5/2007 | McDonough | 441/80 |

FOREIGN PATENT DOCUMENTS

| | | |
|---|---|---|
| DE | 34 43 852 | 6/1986 |
| DE | 196 31 672 | 2/1998 |
| FR | 2185999 | 1/1974 |
| GB | 2240748 | 8/1991 |
| GB | 2268123 | 1/1994 |
| JP | 2004148057 | 5/2004 |
| SU | 908653 | 2/1982 |
| WO | WO 88/03495 | 5/1988 |

OTHER PUBLICATIONS

B.O.B. Sling. http://www.oceanmarinesystems.com/o1_otherbo-brescue.html. 2004.

Markus MOB Boat Rescue-net. http://www.markuslifenet.com/71MLRIB.htm. 2004.

* cited by examiner

*Primary Examiner* — Lars A Olson

(74) *Attorney, Agent, or Firm* — D. Peter Hochberg; Sean F. Mellino; Daniel J. Smola

(57) ABSTRACT

A man overboard rescue device for use on a boat has a net with means of attaching a first end thereof to a boat and with a second opposed end thereof adapted for attaching to a hoisting means. The device further comprising a sinking means, a foreguy and an extendable pole, so as to provide a partially submerged scoop for the man overboard.

17 Claims, 6 Drawing Sheets

MAN-OVER-BOARD RESCUE DEVICE

This application is a National Stage application of International Application No. PCT/AU2008/001370, filed on Sep. 17, 2008, which claims priority to Australian Serial No. 2007905080, filed on Sep. 18, 2007, Australian Serial No. 2007906905, filed on Dec. 17, 2007, and Australian Serial No. 2008902785, filed on Jun. 3, 2008.

BACKGROUND OF THE INVENTION

1. Field of the Invention

The present invention relates to a man overboard rescue device. More particularly, the present invention relates to a man overboard rescue device based on a combined moving scoop and parbuckle design for use on boats which can be either stationary or moving, including sailboats, commercial fishing boats and power boats with a suitable mast, crane or davit system.

2. Description of the Prior Art

A parbuckle is a mechanism which was historically used for lifting barrels onto ships by the use of two ropes. Over time, the parbuckle design was adapted for use on boats as a method of rescuing a man overboard whilst the boat was stationary.

The method involves rigging the foot of a triangular shaped sail to the gunwale of a boat and attaching the head of the sail to the spinnaker halyard. The boat is then positioned alongside the man overboard, whilst the rescuer allows the body of the sail to be dipped into the water. The man overboard then swims or is maneuvered into the cradle formed by the sail, and the halyard is hoisted, and the man overboard is raised up to deck level.

This method is particularly useful with an injured or unconscious man overboard. The method is also desirable for use with a man overboard in cold water who is experiencing hypothermia, because the victim is positioned horizontally during rescue. Lifting a man overboard vertically out of cold water may result in sudden heart failure.

However, the following problems were encountered with this method:

(i) the sail material did not permit the free flow of water therethrough, (ii) the sail could not easily move through the water, (iii) the sail itself could trap water in which an unconscious or injured man overboard could drown, (iv) the sail could not be quickly deployed to rescue the man overboard while enroute to the man overboard because the sail was usually required to propel the boat to the man overboard, (v) the rescuer had to lift the weight of the water which was being pushed and absorbed by the sail in addition to the weight of the man overboard being hoisted, (vi) Wind and waves can push the head of the sail against the boat which prevents the opening of a cradle in which to capture the man overboard, and (vii) the boat had to be stationary to manipulate the man overboard into the device which increases the difficulty of capturing a man overboard when the boat is subject to wind and wave action.

All of these problems made this historic method awkward to use and dangerously ineffective. However, modern variations of the sail parbuckle still suffer from additional problems rendering their effective use impractical. For instance, U.S. Pat. No. 5,779,511 discloses a device which uses a mesh-like material instead of a sail, such as Leno Mesh.

Although this device moves through the water with less resistance than a sail, trials of this technology have revealed the following problems:

(i) it is difficult to get the light-weight material to sink far enough into the water for the man overboard to get into the cradle so formed, (ii) when winds increase, the light-weight material tends to float skyward and twist laterally, making it difficult to manage, (iii) once in the device, a man overboard tends to slip out again because the material is slippery and there is a lack of effective hand grips, (iv) the head of the device is often blown by the wind toward the side of the boat which closes the cradle in which the man overboard is to be captured, and (v) if the boat is moving through the water, the device is pushed backward in the water and so does not form an effective cradle in which to capture the man overboard.

Problems have also been encountered with the overboard rescue devices marketed as the 'Bob Sling' and 'Markus MOB Boat Rescue Net', which comprise net-like material with large-sized holes. These designs can trap body limbs during lifting, and thereby potentially injure or drown the man overboard during his or her rescue.

Any reference herein to known prior art does not, unless the contrary indication appears, constitute an admission that such prior art is commonly known by those skilled in the art to which the invention relates, at the priority date of this application.

SUMMARY OF THE INVENTION

It is an object of the present invention to provide a man overboard rescue device for use on boats which overcomes, or at least substantially ameliorates, the abovementioned problems of the prior art, particularly the need for the boat to be stationary.

According to a first aspect of the present invention, there is provided a man overboard rescue device for use on a boat comprising a net having a means of attaching a first end thereof to a boat and a second opposed end thereof adapted for attaching to a hoisting means; the device further comprising a sinking means, so as to provide a partially submerged scoop for the man overboard.

Preferably, the sinking means is greater on a luff of the device than on a leech of the device, so that the device forms a submerged scoop as the boat approaches the man overboard.

It is preferred that a triangular portion of the second end of the net is removed so as to reduce wind resistance of the device against the boat and open the scoop for the man overboard. More preferably, the device further comprises a means of pushing the second end of the net, attached to the hoisting means, away from the boat so that the device creates an open scoop for the man overboard.

In a preferred embodiment, the device further comprises at least one batten attached to the net so as to reduce the twisting of the net under the action of wind and waves when the device is in use.

More preferably, the device further comprises one or more grabbing ropes which are attached to the net for allowing the man overboard to hold fast to the device.

Preferably the device further comprises a foreguy which is attached by first end thereof to the hoisting means and at a second opposed end thereof to a point toward the bow of the boat so that the device creates an open scoop which is held perpendicular to the midline of the boat. In a preferred embodiment of the present invention the device further includes a bag which is integrally attached to the tack, foot and clew of the device.

More preferably, the device is packed in the bag and folded in a manner so as to facilitate fast deployment during a sea rescue of a man overboard. It is preferred that the bag comprises a means of sealing the device within the bag. More preferably, the means of sealing could be either a zipper or Velcro along the join of the bag, augmented with circumferential length adjustable snap buckles.

Preferably, the bag is removably attached to the gunwale of the boat, but the bag may also be folded for compact storage.

It is also preferred that, the device further comprises light reflecting means so that the device is readily discernable at night.

In a preferred embodiment, the luff and leech of the device consist of brightly coloured fluorescent orange material which is the international colour of nautical safety devices, so that the luff and leech are visible in turbulent white water conditions, and in low light conditions.

It is preferred that the device further comprises a floating lasso means for drawing the man overboard into the device.

According to a second aspect of the present invention there is provided a boat hook comprising a means of hooking objects towards or away from the user, and a shock-absorbing means for moving objects away from a user.

It is preferred that shock-absorbing means comprises a rubber stop at one end of the boathook for pushing objects.

Preferably, the means of hooking objects has smooth edges so as not to damage the objects.

BRIEF DESCRIPTION OF THE DRAWINGS

These and further advantages and features of the invention are illustrated in detail in the following by means of examples and aided by the accompanying figures. In the figures:

FIG. 5 is a close up side view of a boathook according to the present invention.

DETAILED DESCRIPTION OF THE PREFERRED EMBODIMENTS

Figure 1:
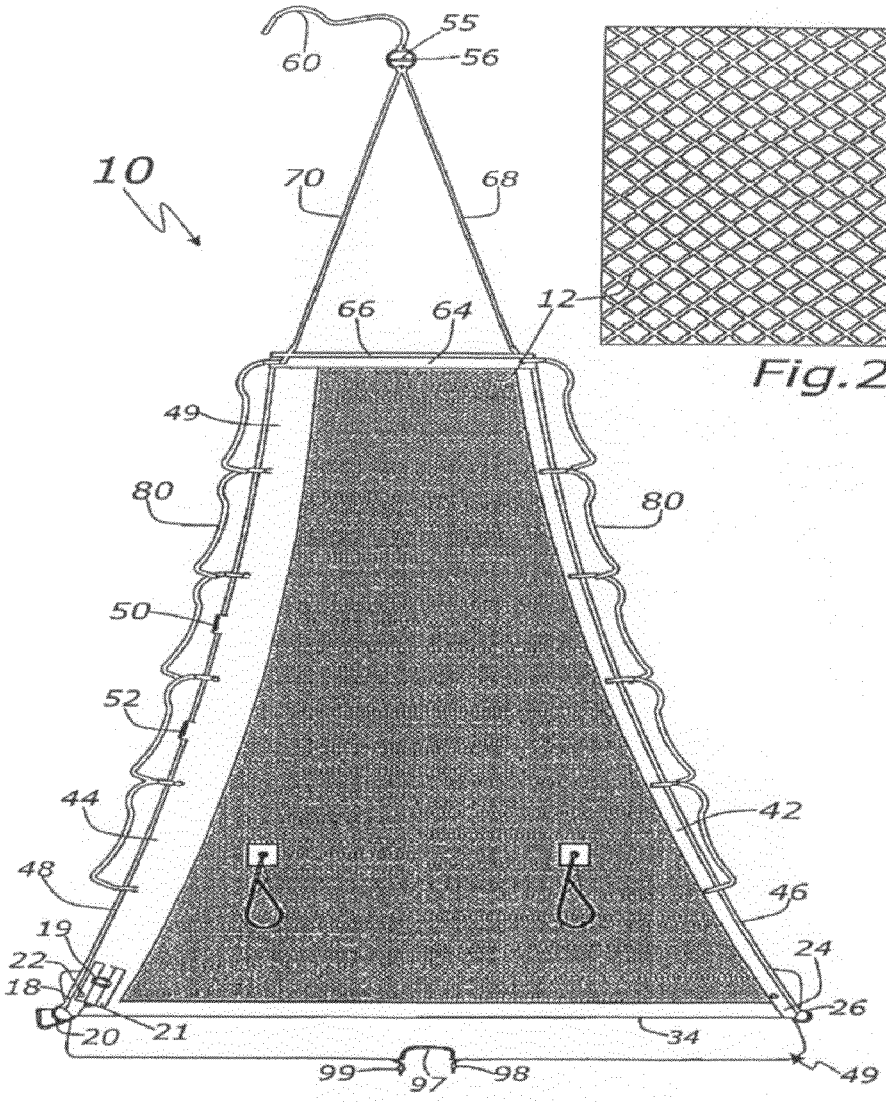
FIG. 1 is a front view of a man overboard rescue device according to the present invention.

As used throughout the disclosure, the following nautical terms, unless otherwise indicated shall be understood to have the following meanings:

"Gunwale" refers to the top edge of the boat's sides that forms a ledge round the whole boat above the deck;

"Tack" refers to the forward corner of the device set along the length of a sailboat that is held down by a rope or clip;

"Luff" refers to the front edge of the device;

"Leech" refers to the aft edge of the device;

"Clew" refers to the aft corner of the device, set along the length of a sail boat;

"Head" refers to the top corner of the device to which is attached the Spinnaker Halyard;

"Spinnaker Halyard" refers to a mechanism used to raise the device up the mast;

"Shrouds" refers to any one of the wires that extend down from the top of a mast to the deck amid ships;

"Batten" refers to a thin flexible strip of wood or plastic inserted in pockets in the device to keep it in shape; Referring to FIG. 1, the device 10 comprises a trapezium shaped net 12.

Whilst the present embodiment of the invention has been depicted as a trapezium, the present invention contemplates the use of other regular shapes including triangles and rectangles or irregular shapes that incorporate curved sides.

Figure 2:
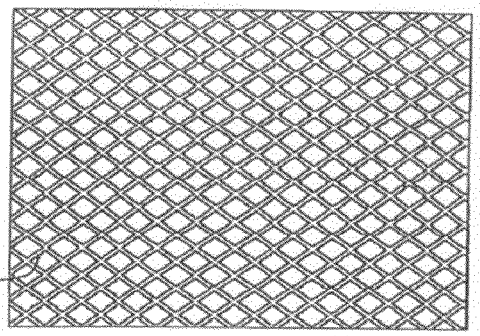
FIG. 2 is a close up view of the net used in the device of FIG. 1 according to a preferred embodiment of the present invention.

A close up of the net 12 is shown in FIG. 2. Preferably, the net 12 is made of knotless nylon with the resting gradations of 11 mm×11 mm, 210 denier, 20 ply (and the stretched gradations are 22 mm×22 mm). The lack of knots prevents injury to the skin of the man overboard.

Unlike prior art devices comprising nets with large gradations (previously mentioned in the background to the invention), the net 12 used in the present invention has sufficiently small gradations to prevent limbs from becoming trapped in the holes during a rescue.

Figure 3:
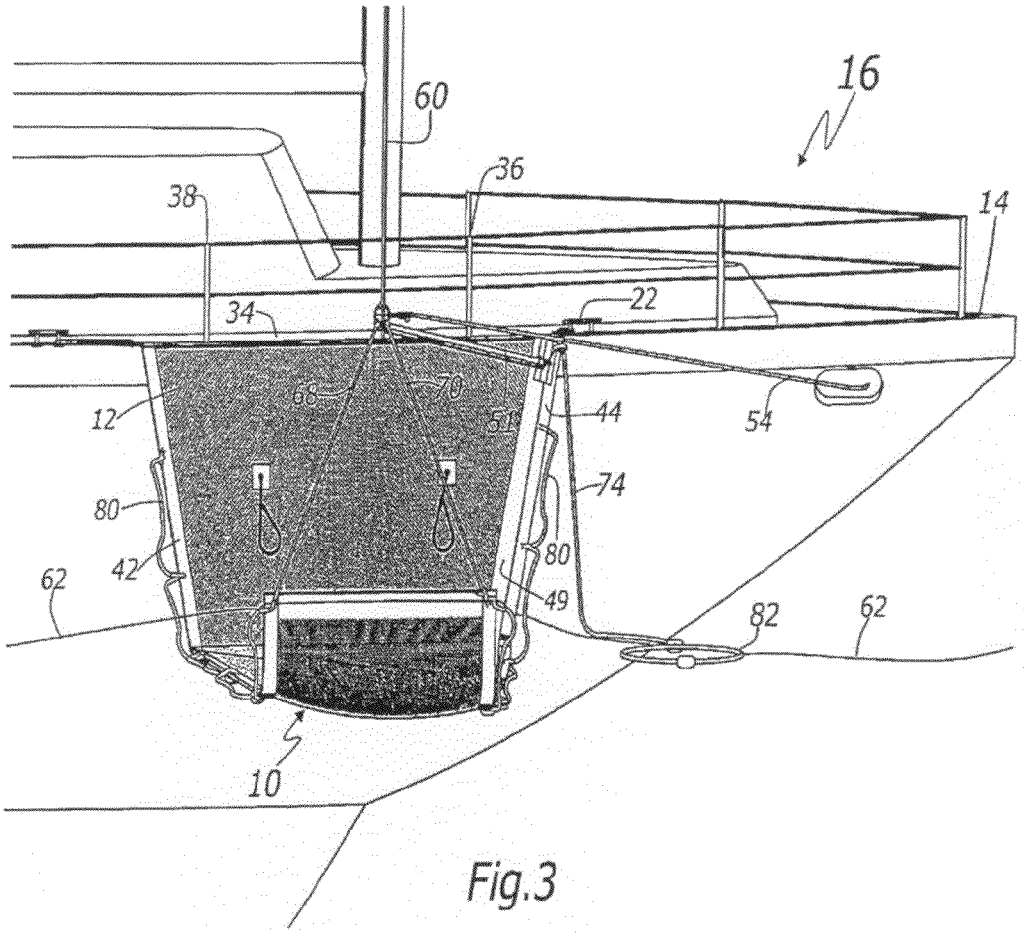
FIG. 3 is a side view of the device of FIG. 1, in use.

When the device 10 is used to retrieve cadavers from the water, as is sometimes required by water police, a heavier material such as a synthetic polymer weave (for instance Ferrari (™) Model No. 392), may be used. This material provides a surface (more so than a net) which may be cleaned, scrubbed and disinfected after retrieval of the cadaver. The device 10 is attached along the gunwale 14 (or toe rail) of the boat 16 (see FIG. 3). In use, the bag 49 which is attached to the foot of the device 10 is unzipped at the aperture 97 (see FIG. 8) which is situated on the centre of the bag 49 using the two burst zip fasteners 98 and 99.

In use, the user marginally opens the two burst zip fasteners 98 and 99, retrieves the head ring 56 and the foreguy 54 and attaches them to the spinnaker halyard 60 and a strong point toward the bow of boat 16, respectively, and in the process the zip fasteners 98 and 99 are burst, opening the bag 49.

The tack 18 of device 10 is secured by a clip 20 (shown in FIG. 1), or a rope loop, to a strong point on the boat, such as the mooring cleat 22.

Figure 4:
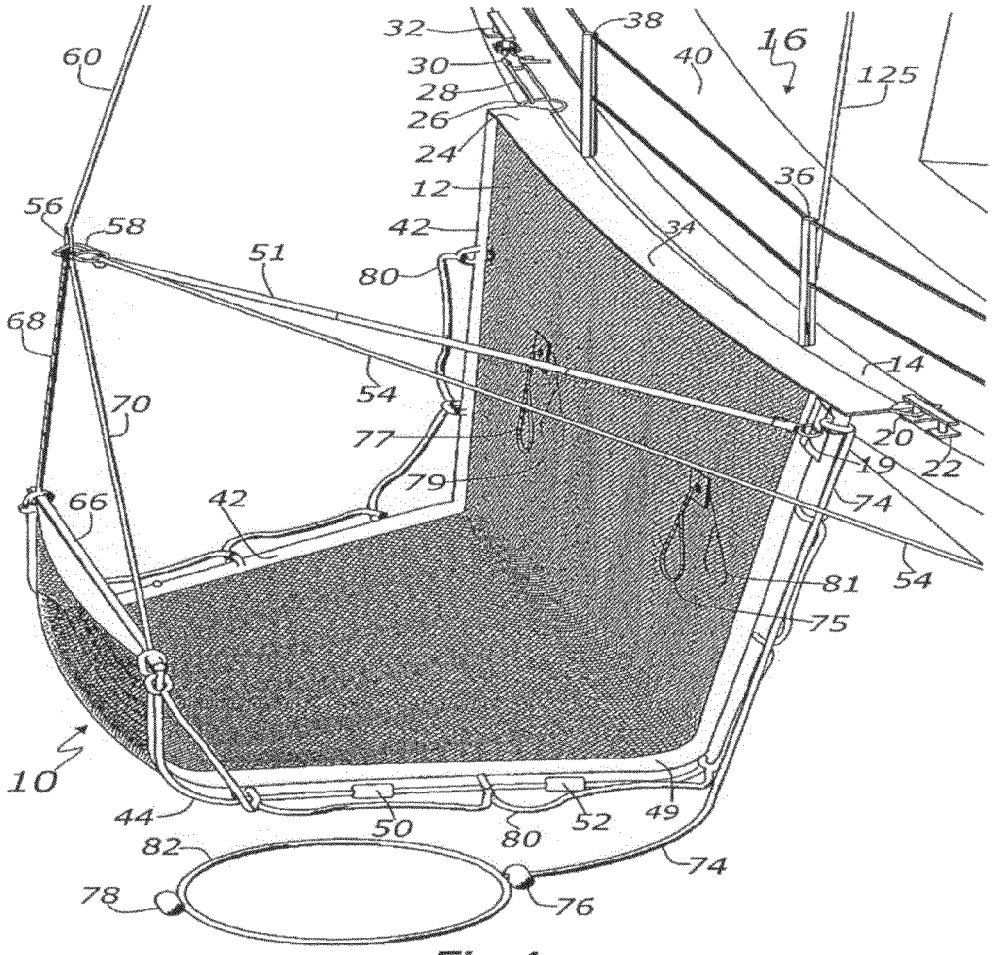
FIG. 4 is a perspective view of the device of FIG. 1, in use.

Referring to FIG. 4, the clew 24 of device 10 is secured by ring 26 which has attached thereto a rope 28 connected to a block and tackle system 30 to a strong point such as the mooring cleat 32, so that the foot 34 can be tensioned up taut against the side of the boat 16 and prevent the man overboard (who is not shown) from slipping through the gap between the foot 34 and the gunwale 14 of the boat 16.

The foot 34 of device 10 should be positioned so that it is between two stanchions 36 and 38 (shown in FIGS. 3 and 4), and adjacent to the shrouds amidships so as to allow the man overboard to be rolled onto the deck 40. Preferably, the foot 34 should be longer than 2 metres, and ideally be around 2.5 metres so that the man overboard's body can be fully enclosed within device 10.

The luff 44 and leech 42 of device 10 are preferably made of a strong polyester weave with a PVC coating. It is also preferred that the luff 44 and leech 42 contain pockets 48 and 46 (refer to FIG. 1) enclosing lead-cored rope, which is used in some commercial fishing nets, to ensure the net sinks. In addition, weights (preferably made of lead) are also inserted at various positions along the lengths of pockets 46 and 48.

These measures ensure the device 10 will sink when deployed. Furthermore, additional weights 50 and 52 are also attached to the luff 44, as shown in FIG. 4, so as to improve the movement of the device 10 through the water as the boat 16 moves along, and to ensure that the luff 44 sinks lower than the leech 42, so that the device 10 acts as a scoop as the boat 16 approaches the man overboard. This effect can be seen in FIG. 3.

This enables the device 10 to be used whilst the boat 16 is in motion, unlike prior art devices which require the boat to be stationary in order for prior art man overboard devices to be effective. This scooping action enhances the prospects of being able to capture the man overboard in conditions where there is considerable wind and wave activity and also where forward motion of the boat 16 is essential for maneuvering the boat 16 close to the man overboard.

The material forming the luff 44 is wider than the leech 42, so that the luff 44 cuts through the water without twisting. A problem with prior art devices is that they are swept back with the motion of water as the boat is moving, so that a scoop is not created in order to effectively capture the man overboard.

In order to further prevent the device 10 from being swept back whilst the boat is in motion, the present invention comprises a foreguy 54, which is preferably a floating polypropylene rope, in order to minimize the risk of propeller entanglement. The foreguy 54 is connected to ring 56, which may be made of stainless steel, at the apex of device 10 (see FIG. 1) via clip 58 (see FIG. 4). In the alternative, clip 58 could be replaced by a splice, or bowline knot or any other means of affixing the foreguy 54 to the ring 56. The other end of the foreguy 54 is connected to a strong point toward the bow of boat 16 (see for instance FIG. 3). The foreguy 54 prevents the spinnaker halyard 60 from moving to a position which is not substantially perpendicular to the direction of motion of the boat 16.

Preferably the foreguy 54 is stored within a bag (not shown), wherein the bag comprises a hole in its bottom through which the foreguy is passed, the bag also having an open top sealed with Velcro, into which the foreguy 54 is flaked to prevent entanglement.

Another problem often experienced with prior art devices is that the force of wind and waves on the portion of the device 10 which is above the surface of the water 62 (see FIGS. 1, 3, 4, and 6) pushes the top portion toward the side of the boat 16, closing the scoop in which to capture the man overboard.

Therefore, the present invention has removed the top portion of the device 10 which is present in all prior art devices, as this portion is not actually operative during the rescue or retrieval of a man overboard.

The top portion has been replaced by two lines 68 and 70, which effectively decreases the overall wind and wave resistance of the device 10. The two lines 68 and 70 are connected to the ring 56, as can be seen in FIGS. 1 and 5.

Figure 7:
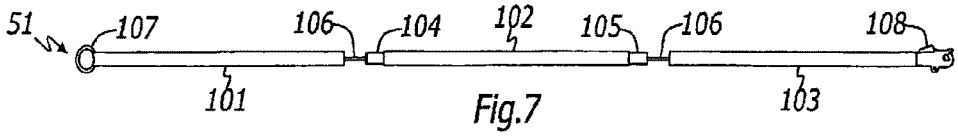
FIG. 7 is a side view of the extendable pole of FIG. 4.

Two mechanisms may be used to open the scoop. Firstly, an extendable jockey pole 51 may be used for opening the scoop to capture the man overboard. The pole 51 is shown in use in FIG. 4, and also in FIG. 7. In this instance, the extendable pole 51 comprises interlocking sections 101, 102 and 103, which are connected by an internal elasticised rope 106.

Section 102 has sleeves 104 and 105 which interlock with sections 101 and 103 respectively. The pole 51 has a ring 107 (or some other connecting means) at first end which, in use, attaches to the cross bar 55 (see FIG. 1) on the ring 56 via a shackle (which is not shown in the figures). The pole 51 also has a clip 108 at a second opposed end which, in use, attaches to the ring 19 on the device 10 also shown in FIG. 4.

Figure 6:
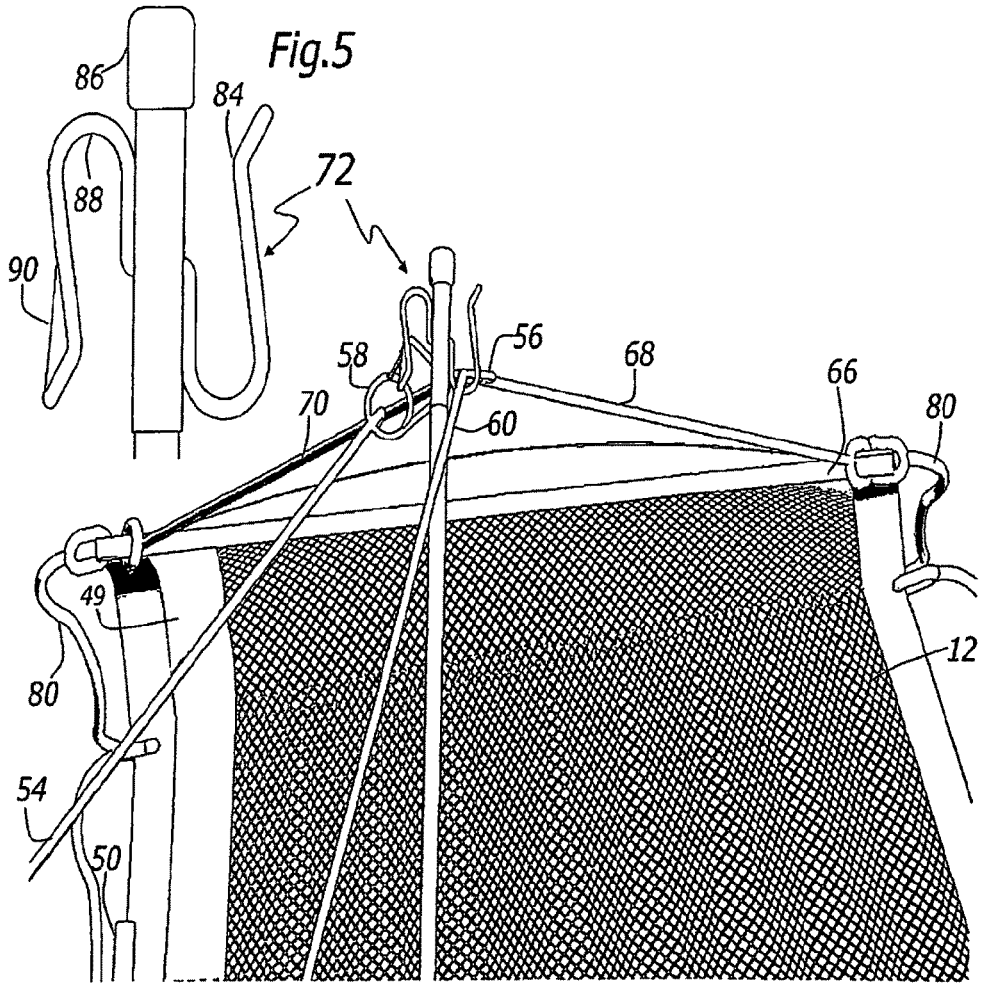
FIG. 6 is a perspective view of the boathook of FIG. 6, in use with the device of FIG. 1.

In the embodiment depicted in the drawings, the extendable jockey pole 51 is of 2370 mm in length, and is preferably made of carbon fibre, but may also be made of plastic, anodised aluminium, fiberglass or stainless steel. When the device 10 is not in use, the extendable pole 51 can be stored in a collapsed state so that the extendable pole 51 may be easily and quickly deployed in an emergency. Secondly, as an alternative means of opening the scoop and also as an aid in capturing the man overboard, the present invention also comprises a novel boathook 72, shown in FIGS. 5 and 6. The boathook comprises two curved protrusions 84 and 88, which are almost inverse-mirror images of each other. Protrusion 84 is designed to catch and push ropes, such as is illustrated in FIG. 6, wherein protrusion 84 is being used to push spinnaker halyard 60. The boathook 72 also has a rubber stop 86 which can be used to push the man overboard into the scoop or can be used to push the boat 16 off a dock or away from another boat, for instance.

The boathook 72 of the present invention also has novel protrusion 88 which can also be used to hook and draw ropes toward the user, or to hook onto the clothing of a man overboard in order to assist in his or her rescue. The protrusion 88 has a flange 90 which is intended to minimise injury to a man overboard, should the boathook 72 be required to assist in his or her rescue.

As can be seen in FIGS. 1 and 6, the device 10 comprises a batten 66 which is sewn into the top 64 of device 10. The batten 66 reduces the lateral twisting of device 10 under the action of wind and waves, a significant problem experienced by prior art devices. Again, twisting of the device 10 prevents an effective scoop from being opened in which to capture the man overboard. Preferably the batten 66 is a solid fiberglass rod.

The luff 44 and leech 42 of device 10 consist of brightly coloured material, preferably in fluorescent orange—the international colour of nautical safety devices, so that said luff 44 and leech 42 are visible in turbulent white water conditions, and in low light. The length of luff 44 and leech 42 can vary with the freeboard of the boat. A length of around 3.8 metres is reasonable.

In addition, reflective tape can be placed on the luff 44 and leech 42 of device 10 so that it is visible at night with deck lights or torches. In use of device 10, the man overboard can be winched and hoisted aboard by a single person standing on the deck 40 of the boat 16 using either a spinnaker halyard with a mechanical winch or a block and tackle system, whilst the boat is moving at low speed.

Referring to FIG. 4, a throwing line 74 is connected to the tack 20 for throwing to a man overboard who is out of reach of boathook 72 and needs to be hauled into the device 10.

The throwing line 74 should be approximately 20 metre in length, adapted to float, and is preferably a highly visible colour, such as yellow. The throwing line 74 also has a rope lasso 82 at its end of sufficient diameter to fit around a man overboard wearing a life-jacket.

In this instance, the lasso 82 is polyethylene floating rope of around 20 mm in width. Floatation devices 76 and 78 are attached to the lasso 82. Preferably, the throwing line 74 is stored within a bag (in a similar arrangement to the foreguy 54), wherein the bag comprises a hole in its bottom through which the throwing line is passed, and a open top sealed with Velcro, into which the throwing line 74 is flaked.

A series of iridescent yellow polypropylene floating rope loops 80 are attached to the luff 44 and leech 42 to allow the man overboard to grab or loop an elbow though the device 10 in poor weather conditions.

In addition, the device 10 has grab loops 75 and 77 on the front side of the device 10, and corresponding grab loops 79 and 81 on the rear side of the device 10 (see FIG. 4) so that the man overboard can connect with the side of the boat 16.

In a preferred embodiment the device 10 is packed within the bag 49 in such a manner that it can be quickly and easily deployed, retracted and transported (see FIGS. 8 to 11). In circumstances where the risk of a man overboard is high, the bag 49 may also be left attached to the gunwale 14 of the boat 16 for extended periods of time.

The bag 49 is adapted to house the device 10, along with all of the tools associated with the device such as the extendable jockey pole 51 and the throwing line 74.

The bag 49 may be made of a polyester weave with PVC coating, and is preferably coloured in white to blend in with the side of a white boat, and thereby be visually unobtrusive.

Figure 8:
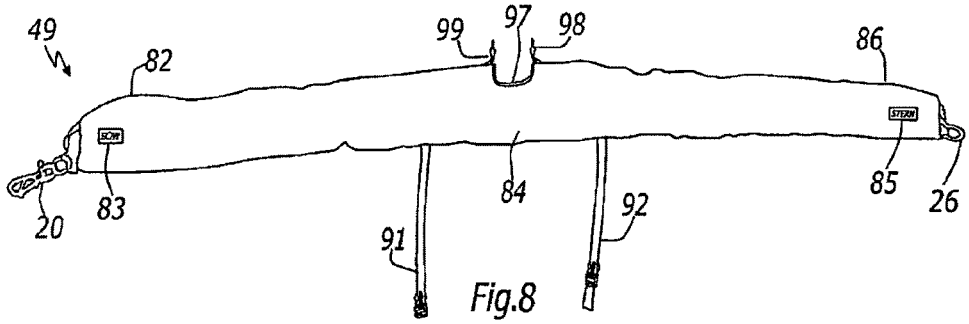
FIG. 8 is a bag for use with the device of FIG. 1.

As shown in FIG. 8, the bag 49 comprises three sections: a bow section 82, a middle section 84, and a stern section 86. The bow section 82 features a label 83 to assist the user position the bag with respect to the boat 16. The stern section 86 also features a label 85.

Figure 9:
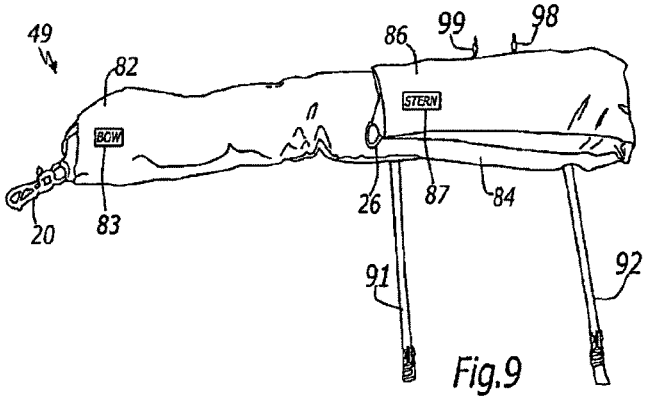
FIG. 9 is the bag of FIG. 8 shown with the stern section folded.

The stern section 86 is folded onto the middle section 84, as shown in FIG. 9, revealing the stern label 87 on the other side of the stern section 86 of the bag 49.

Figure 10:
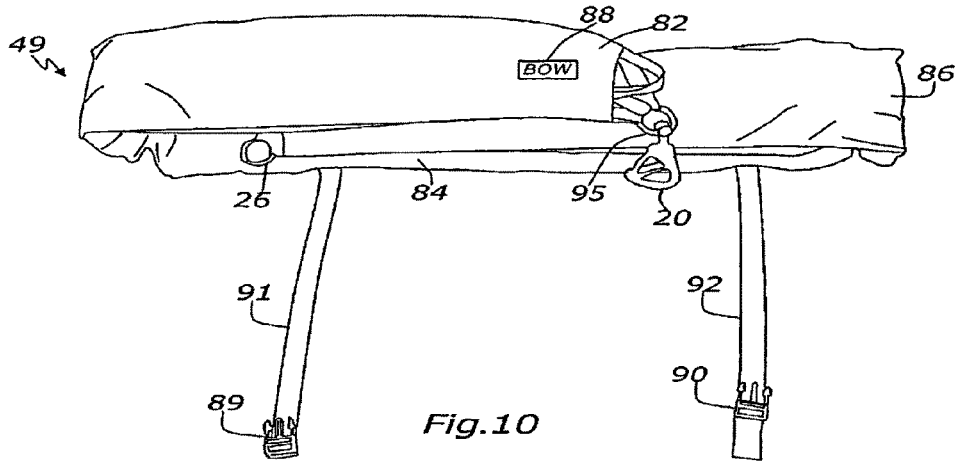
FIG. 10 is the bag of FIG. 8 with the bow section folded.

As shown in FIG. 10, the bow section 82 is then folded onto the stern section 86, revealing a second bow label 88.

Figure 11:
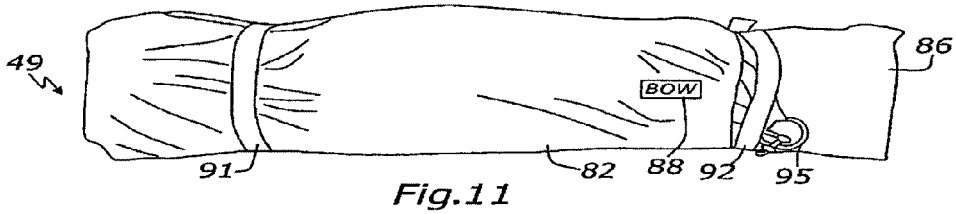
FIG. 11 is the bag of FIG. 8 with the bow and stern sections secured.

The three folded sections 82, 84 and 86 are kept in position by means of the length adjustable snap buckles 89 and 90 (affixed to straps 91 and 92 respectively), which are wrapped around the bag 49 (see FIG. 11).

Figure 12:
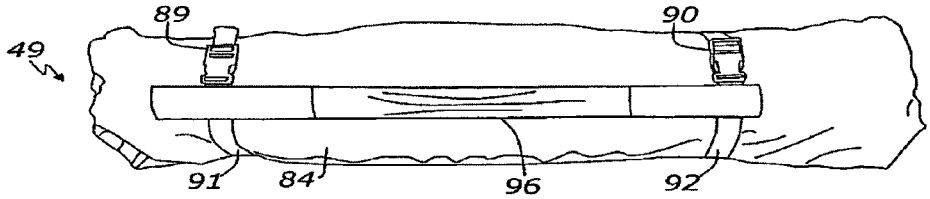
FIG. 12 is the bag of FIG. 11 flipped, showing the carry handle.

The bag 49 can then be turned over, as shown in FIG. 12, and carried using the handle 96, and thereby conveniently transported.

Various modifications may be made in details of design and construction without departing from the scope and ambit of the invention.

The invention claimed is:

1. A man overboard rescue device for use on a boat in water, the boat having a bow, a midline and a gunwale, said device comprising:

a net having a first end and a second opposed end, said first end having attaching structure for attaching the first end to the boat and said second opposed end for being attached to a hoisting structure, a foreguy attaching said first end to said hoisting structure and said foreguy attaching said second opposed end to a point toward the bow of the boat for creating an open scoop being held perpendicular to the midline of the boat while the boat is in motion, a luff having ends, said luff being a front edge of the device, a leach, said leach being an aft edge of the device, a sinking structure for partially submerging said scoop underwater for the man overboard, wherein the sinking structure is greater on said luff of the device than on said leech of the device, and at least a portion of said sinking structure being deployed on the luff of the device between the ends of the luff for forming said partially submerged scoop as the boat approaches the man overboard.

2. The device of claim 1, further comprising a removable triangular portion of the second opposed end of the net for being removed to reduce wind resistance of the device against the boat and for opening the scoop for the man overboard.

3. The device of claim 1, further comprising pushing structure for pushing the second end of the net away from the boat for creating the open scoop for the man overboard.

4. The device of claim 1, further comprising at least one batten attached to the net in association with the second opposed end of the net for reducing the twisting of the net under the action of wind and waves when the device is in use.

5. The device of claim 1, further comprising at least one grabbing rope attached to the net for allowing the man overboard to hold fast to the device.

6. The device of claim 1, further comprising a tack, a foot and a clew for attaching said device to the boat; and a bag for storing the device, said bag integrally attaching to the tack, foot and clew of the device.

7. The device of claim 6, wherein the device is packed in the bag and folded in a manner for facilitating fast deployment during a sea rescue of a man overboard.

8. The device of claim 6, wherein the bag comprises sealing structure for sealing the device within the bag.

9. The device of claim 8, said bag further comprising a join, wherein the sealing structure comprises at least one zipper along the join of the bag, augmented with at least one circumferential length adjustable snap buckle.

10. The device of claim 9, wherein the at least one zipper is at least one burst zip fastener.

11. The device of claim 6, wherein the bag is removably attached to the gunwale of the boat, and is foldable for compact storage.

12. The device of claim 1, further comprising light reflecting structure for readily discerning the device at night.

13. The device of claim 1, wherein the luff and leech of the device comprise brightly coloured fluorescent orange material, making the luff and leech visible in turbulent white water conditions, and in low light conditions.

14. The device of claim 1, further comprising a floating lasso structure for drawing the man overboard into the device.

15. The device of claim 1, further comprising a boat hook for pushing or pulling an object, said boat hook comprising a hooking structure for hooking the object and pulling towards or pushing away the object from the boat, and a shock-absorbing structure for moving the object away from the boat.

16. The device of claim 15, wherein the boat hook has two ends and wherein the shock-absorbing structure comprises a rubber stop at one end of the boat hook.

17. The device of claim 15, wherein the hooking structure comprises smooth edges for preventing damage to the object.

* * * * *